US012791256B2

(12) United States Patent
Cunningham et al.

(10) Patent No.: US 12,791,256 B2
(45) Date of Patent: Nov. 10, 2026

(54) ARRANGEMENT OF HELICAL TUBES FOR EFFICIENT PACKING AND APPARATUS IMPLEMENTING THE SAME

(71) Applicant: Neal Technologies Inc., Mesa, AZ (US)

(72) Inventors: James Cunningham, Mesa, AZ (US); Mitchell Roberts, San Tan Valley, AZ (US)

( * ) Notice: Subject to any disclaimer, the term of this patent is extended or adjusted under 35 U.S.C. 154(b) by 247 days.

(21) Appl. No.: 18/531,534

(22) Filed: Dec. 6, 2023

(65) Prior Publication Data

US 2024/0183618 A1 Jun. 6, 2024

Related U.S. Application Data

(60) Provisional application No. 63/430,484, filed on Dec. 6, 2022.

(51) Int. Cl.
*F28D 7/02* (2006.01)
*F28F 1/00* (2006.01)

(52) U.S. Cl.
CPC ..... *F28D 7/024* (2013.01); *F28F 1/006* (2013.01); *F28F 2210/10* (2013.01)

(58) Field of Classification Search
CPC ..... F28D 7/024; F28F 1/006; F28F 2210/10
See application file for complete search history.

(56) References Cited

U.S. PATENT DOCUMENTS

| | | | | |
|---|---|---|---|---|
| 2,693,346 | A * | 11/1954 | Holger | F28D 7/024 165/145 |
| 4,589,481 | A * | 5/1986 | Mansson | F28F 1/025 165/910 |
| 4,619,317 | A * | 10/1986 | Disselbeck | F24S 20/40 165/DIG. 405 |
| 9,541,331 | B2 | 1/2017 | Nagurny et al. | |
| 9,605,912 | B2 * | 3/2017 | Neal | F02M 26/32 |
| 9,964,077 | B2 | 5/2018 | Neal et al. | |
| 12,152,839 | B2 * | 11/2024 | Wiedenhoefer | F28D 7/024 |
| 2008/0135219 | A1 * | 6/2008 | Doh | F28D 7/082 165/156 |
| 2011/0011572 | A1 * | 1/2011 | Nagurny | F28F 21/084 165/172 |
| 2013/0277022 | A1 * | 10/2013 | Neal | F28F 9/00 165/163 |
| 2017/0175684 | A1 * | 6/2017 | Neal | F01P 3/20 |
| 2018/0283795 | A1 * | 10/2018 | Cerny | F28F 1/12 |
| 2023/0110296 | A1 * | 4/2023 | Charamko | F28F 1/06 165/163 |

FOREIGN PATENT DOCUMENTS

| | | |
|---|---|---|
| CN | 106643254 A | 5/2017 |
| JP | 03-178668 A | 2/1991 |

* cited by examiner

*Primary Examiner* — Devon Lane
(74) *Attorney, Agent, or Firm* — Hartman Titus PLC; Joseph W Mott

(57) ABSTRACT

An improved packing efficiency of helical tube bundles of the same twist in a heat exchanger is achieved by selecting the angular orientation of the tube bundles so as to allow them to nest together in phase so that peaks of adjacent tube bundles are located between each other, forming a bundle overlap. An exemplary application is an EGR cooler.

16 Claims, 9 Drawing Sheets

ARRANGEMENT OF HELICAL TUBES FOR EFFICIENT PACKING AND APPARATUS IMPLEMENTING THE SAME

TECHNICAL FIELD OF THE INVENTION

The present disclosure relates to the efficient configuration of bundles of helical tubes, particularly in heat transfer applications.

BACKGROUND OF THE INVENTION

Helical tubing is a long-established technology for effective heat exchange between two fluids. In one application, as illustrated by U.S. Pat. No. 2,693,346, heat is transferred from fluid inside the helical tube to the fluid flowing around the tube, for example, high pressure steam from a remote steam generator is forced through the helical tubes to heat water flowing around them. In another, as illustrated by U.S. Pat. No. 9,605,912, hot vehicle exhaust gases inside the helical tubes are cooled by transfer of heat to engine coolant flowing around the coils.

A significant advantage of a helical tube or coil over a straight tube is that for a given enclosure length and tube diameter, a coil affords substantially more surface area over which to exchange heat with the surrounding fluid. Multiple coils may be interleaved around a common central axis to form a coil bundle. Coil bundles may be precisely positioned next to each other to optimize the number of tubes in an enclosure.

U.S. Pat. No. 9605912 discloses configuration of helical coil tube bundles in a heat exchanger for transferring heat between two fluids, for example between a hot exhaust gas and a liquid coolant. In one embodiment, the heat exchanger comprises a shell surrounding at least two tube bundles attached at both ends to a tube header. Each of the tube bundles is constructed from a plurality of individual tubes that are twisted into identical helixes formed about a common helical axis.

In the preferred configuration, two 3-tube bundles are formed with opposite helical twists, i.e., the first tube bundle has tubes wound in a helix having a right-hand helix and the second tube bundle has tubes wound in a left-hand helix. The tubes have identical diameter, pitch and helical diameter, and the helical axes of the bundles are parallel. Because the tubes in the bundles having opposite-twist can nest together without the helixes crossing over, the tube bundles can be positioned with their helical axes closer to each other than would be possible if all of the tube bundles had the same direction of twist. The heat exchanger may then be formed of several tube bundles arranged in a rectangular array with each tube bundle having the opposite twist from each of the adjacent tube bundles. This configuration increases the number of helical tube bundles that fit within the heat exchanger shell.

US Pat. No. 9964077 discloses efficient configurations of 2-tube bundles formed with opposite helical twists in patterns of two or four bundles.

The foregoing patents disclose arrangements of bundles where the bundles have opposite helical twists. It may be desirable in some circumstances to configure a heat exchanger with helical tube bundles that all have the same twist. For example, if tubes are all the same twist it is not necessary to maintain the tooling and programs to produce tubes of different twist direction. Moreover, assembly is simpler because it is not necessary to correctly position the different bundles, and bundle inventory management is simplified because there is only one type of bundle.

SUMMARY OF THE INVENTION

An improved packing efficiency of helical tube bundles of the same twist in a heat exchanger is achieved by selecting the angular orientation of the tube bundles so as to allow them to nest together in phase so that peaks of adjacent tube bundles are located between each other, forming a bundle overlap.

DETAILED DESCRIPTION

A helix can be mathematically defined by a system of parametric equations. A mathematical helix (defined as a curve for which the tangent makes a constant angle with a fixed line) with a diameter D and pitch P, can be parameterized by Θ is:

$$x(\theta) = \frac{D}{2}\cos\theta$$

$$y(\theta) = \frac{D}{2}\sin\theta$$

$$z(\theta) = -\frac{\theta \cdot P}{2\pi} = -\frac{\theta \cdot P}{360^\circ}$$

Figure 1:
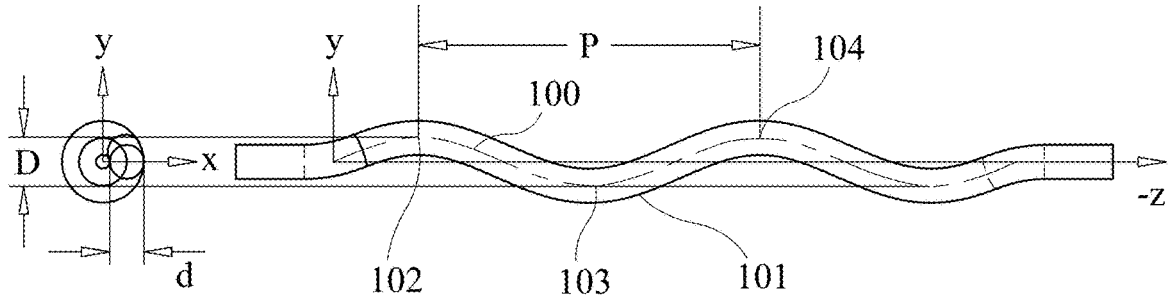
FIG. 1 is an end and side view of a helically wound tube.

The centerline 100 of a cylindrical tube 101 or wire formed into a helix is shown in FIG. 1. Viewed from the side the centerline of tube 101 is a wave in which D is the distance between the peak 102 and valley 103 of the centerline, and P is the length of the wave from peak 102 to the following peak 104. Viewed end on, D is the coil diameter of the tube helix and d is the diameter of the tube itself. As tubes are added to the bundle, with the coil diameter and tube diameter remaining the same, the wave is replicated and shifted. See, e.g., FIGS. 2, 4 and 6. When the tubes are equally spaced about the helix axis, we can define the phase angle $\phi$ as:

$$\Phi = \frac{360^\circ}{\#\text{ of Tubes per Bundle}} = \frac{360^\circ}{N}$$

Figure 2:
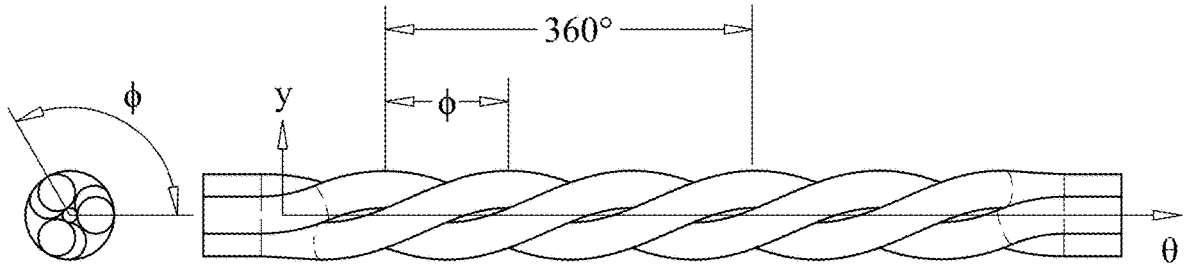
FIG. 2 is an end and side view of a bundle of 3 helically wound tubes.

FIG. 2 shows a bundle of 3 tubes in terms of $\phi$ (instead of z). The waves of additional tubes are spaced at an angle of $\phi$. This makes the centerline equations of additional tubes of the bundle:

$$y_{Tube\,n}(\theta) = \frac{D}{2}\sin(\theta + (n-1)\Phi)$$

Figure 3:
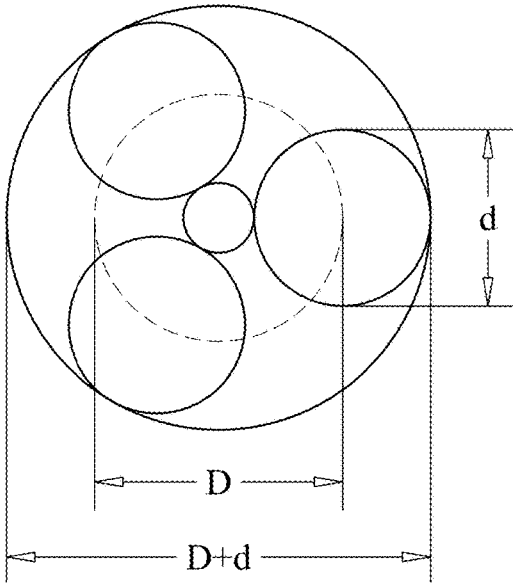
FIG. 3 is a close-up of the end view of FIG. 2.

As used herein, d will refer to the outside diameter of the tube, so the helical bundle outside diameter is D+d, as seen in FIG. 3.

Figure 4:
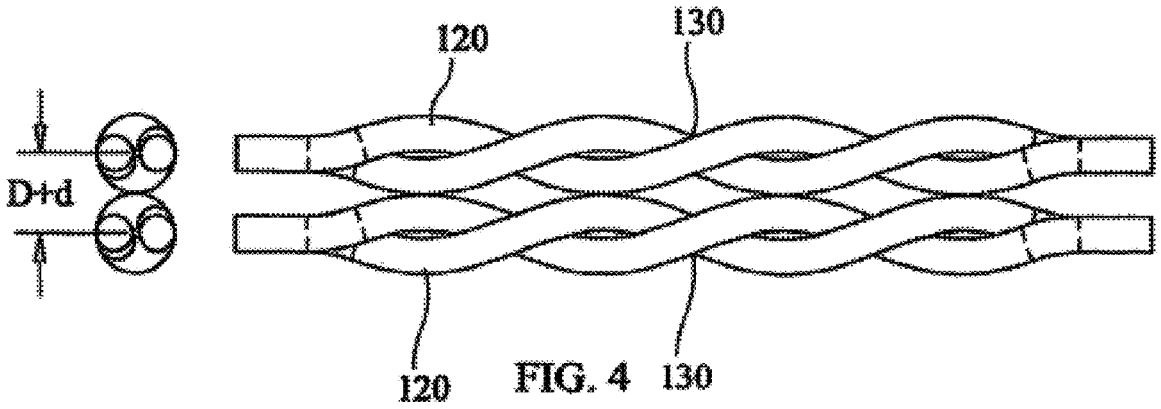
FIG. 4 shows a pair of adjacent 2-tube bundles of helically wound tubes.

Obviously, as seen in FIG. 4, two adjacent bundles can be spaced apart at least as close as one bundle outside diameter:

$$\text{Bundle Spacing} = 2\cdot\text{Bundle Radius} = 2\cdot\left(\frac{D+d}{2}\right) = D+d$$

Figure 5:
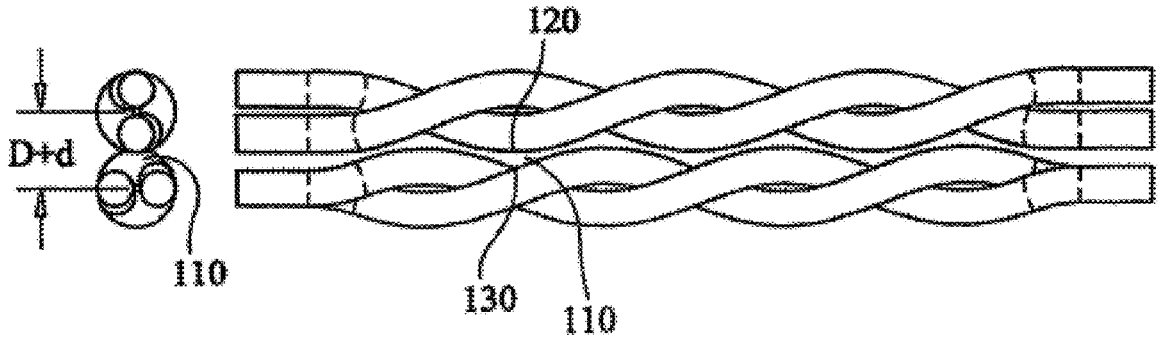
FIG. 5 shows a pair of adjacent 2-tube bundles of helically wound tubes positioned with peaks of one bundle aligned with valleys of the other.

However, the waves of the helical tube bundle create peaks 120 and valleys 130. When adjacent bundles have the same pitch, they can be rotationally positioned or phased such that the peaks of one bundle align with the valleys of the adjacent bundle. FIG. 5 shows that adjacent bundles can be phased with each other (e.g., by rotating the bundle so as to shift the peaks and valleys of the helical tubes forward or backwards relative to the adjacent bundle) such that there is clearance 110 between the bundles. The greatest available clearance occurs when the peak 120 of one bundle aligns with the valley 130 of the adjacent bundle. Such clearance means that adjacent bundles can be oriented (FIG. 6) and positioned (FIG. 7) for bundle overlap, with the peaks of one bundle between the peaks of an adjacent bundle, making the bundles closer to each other than one bundle outside diameter. This results in: Bundle Spacing<(D+d). For clarity, the presence of bundle overlap is described herein as a condition wherein the peaks of one bundle are positioned between the peaks (i.e., in the valleys) of an adjacent bundle. Stated otherwise, at least one peak of a bundle is positioned to intersect the imaginary line connecting the two closest peaks of the adjacent bundle.

Figure 6:
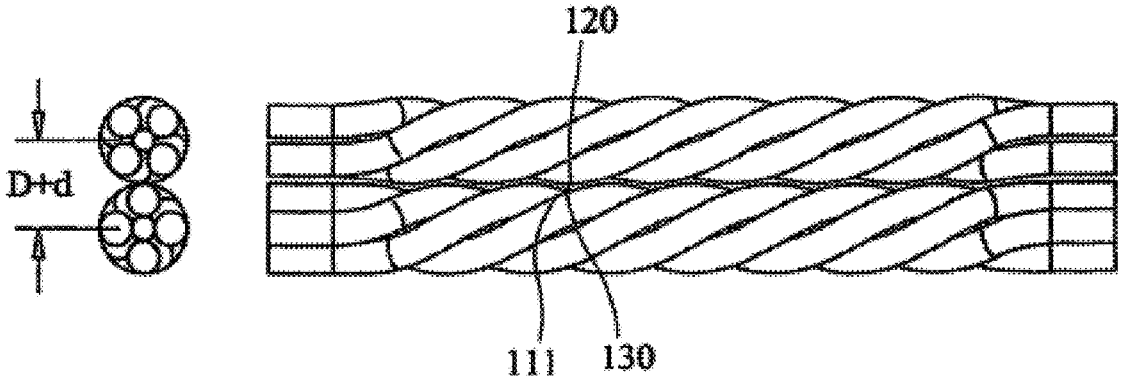
FIG. 6 shows a pair of 4-tube bundles.

When the number of tubes per bundle increases, the clearance, and thus the possible amount of bundle overlap, is reduced, as illustrated with 4-tube bundles in FIG. 6. There, the clearance 111 between bundles is less than the clearance 110 in the case of 2-tube bundles. Even though the potential bundle overlap may be small, some portion of the peaks of adjacent multiple tube bundles will always fit between each other.

Figure 7:
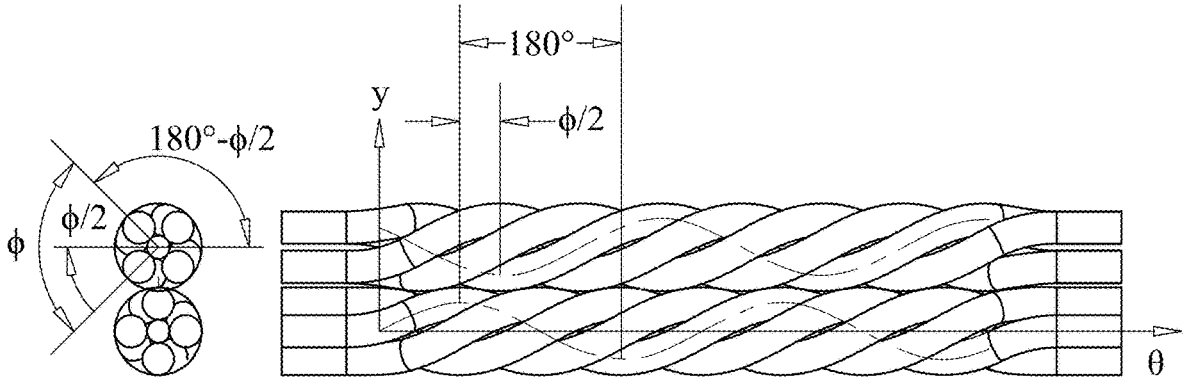
FIG. 7 shows a pair of tube bundles positioned in phase according to the claimed invention.

To center the peaks 120 of one tube bundle in the valleys 130 of an adjacent bundle, permitting the minimum bundle spacing, the phase shift between bundles is:

$$\frac{360^\circ - \Phi}{2} = 180^\circ - \frac{\Phi}{2}$$

which is depicted graphically in FIG. 7.

This derivation shifts the corresponding tube of an adjacent bundle such that the valley of the corresponding adjacent tube wave is phased with the peak of the initial tube wave. The peak and valley of a sine wave are 180° apart. However, when there are more than two (2) tubes per bundle, N>2, this phase shift is greater than necessary as the corresponding tube of the adjacent bundle could be shifted to be in phase with a different tube of the initial bundle. In actuality, bundles of an odd number of tubes do not require a phase shift to be in phase with an adjacent bundle, whereas bundles of an even number of tubes require a minimum phase shift of ($\phi$/2).

Figure 8:
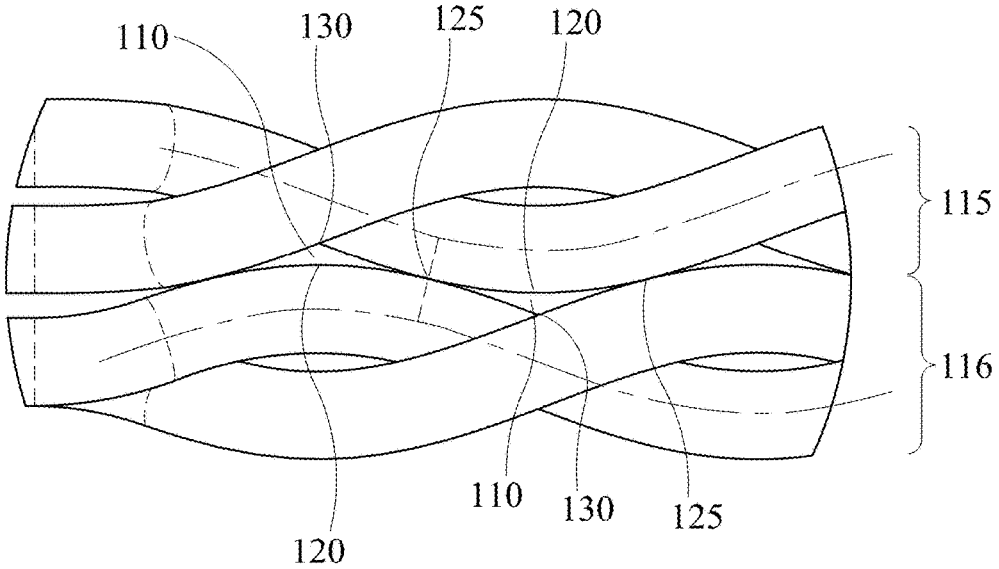
FIG. 8 shows a pair of tube bundles positioned so that the peaks of one bundle are centered in the valleys of the adjacent bundle and depicting where the tubes touch tangent.

The minimum bundle spacing is where the helical tubes or wires touch tangent to each other. FIG. 8 shows adjacent tube bundles 115 and 116 positioned for minimum bundle spacing. The peaks 120 of each bundle are aligned with the valleys 130 of the adjacent bundle. The walls of adjacent tubes touch tangent at 125 and the clearance 110 between tube bundles is minimized and the center-to-center spacing is less than the outside diameter of the tube bundles D+d.

As discussed above, pairs of same-twist helical tube bundles can be positioned adjacent to each other to yield closer spacing than the standard D+d boundary. In a multi-tube heat exchanger, many tube bundles must be packed together. The fact that pairs of bundles can be phased with each other does not necessarily generate close spacing throughout the enclosure.

Figure 9:
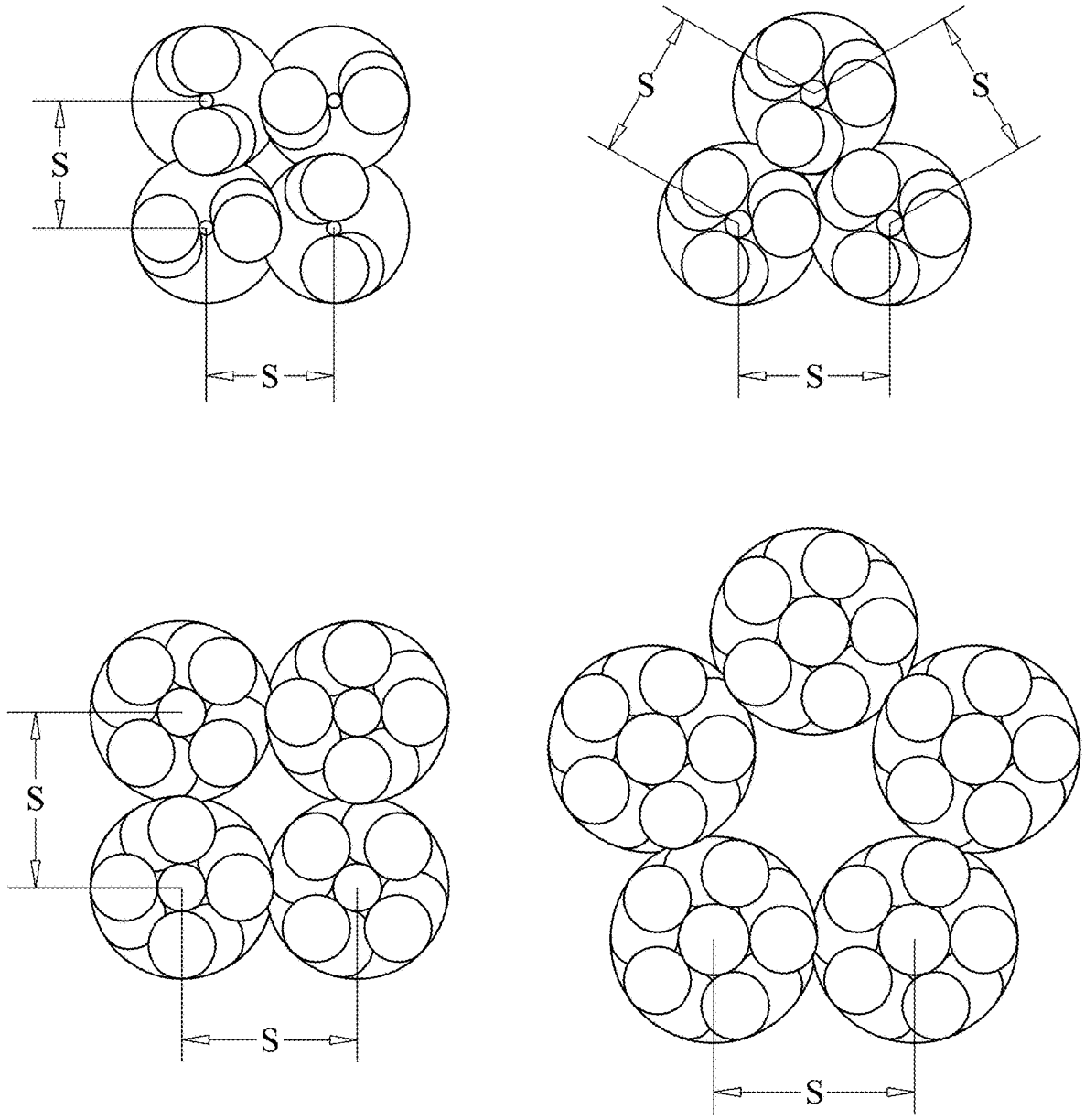
FIG. 9 shows end views of alternate tube bundle combinations.

It has been discovered that when the number of bundles in a pattern is an integer times the number of tubes in bundle, then a special situation occurs where the last bundle of the pattern falls in phase with the first bundle of the pattern. This allows the maximum bundle overlap between the last bundle of the pattern and the first bundle of the pattern. This holds true for pattern units of two or four 2-tube bundles, three 3-tube bundles, four 4-tube bundles and five 5-tube bundles. See FIG. 9. Any of these pattern units can be replicated throughout the enclosure, leaving adjacent bundles in phase with each other.

A tube and shell heat exchanger, comprising an encasement carrying one fluid and a plurality of tubes carrying another fluid is an example of an apparatus that benefits from inserting the maximum practical number of tubes inside the casing. A particular embodiment of such a heat exchanger is an EGR cooler that cools the exhaust gas of a diesel engine. EGR cooler designs are discussed in U.S. Pat Nos. 9,605,912 and 9,964,077, both of which are incorporated by reference hereby. These patents explain the advantages of helical coil tube components and an arrangement of opposite-twist coils that increases the number of tubes in a defined cooler enclosure.

The improved configuration of tubes disclosed in U.S. Pat. No. 9,605,912 works only with an even number of bundles per pattern unit. Where a configuration using an odd number (such as 3) bundles per pattern unit is desired, at least 2 of the helical tubes must have the same hand twist. Although adjacent tube bundles of the same hand twist cannot be positioned as close together as adjacent bundles of opposite hand twist, the current discovery that adjacent bundles of the same hand twist can be spaced closer than S=D+d when positioned in phase does yield a packing efficiency improvement.

The advantage achieved by positioning tube bundles as described herein may be seen by calculating two parameters: bundle spacing and packing efficiency. If the centerline of a helical, constant diameter tube is modeled by $$\vec{r} = (y(t), z(t))$$

Then its outside surface is a parallel curve can be described by the equation $$\vec{r}_k = \vec{r}(t) + k\vec{n}(t)$$

Where |k| is the normal distance from the centerline to the parallel curve and $\vec{n}(t)$ is the unit normal vector. (Note that the parameter θ has been replaced with t to reduce confusion). The distance |k| would be the tube radius, or $$k = \frac{d}{2}$$

Two adjacent bundles with tubes having the centerline equations $$\vec{r}_1 = (y_1(t), z(t))$$

$$\vec{r}_2 = (y_2(t), z(t))$$

Would have outside surfaces $$\vec{r}_{k_1} = \vec{r}_1(t) + \frac{d_1}{2}\vec{n}_1(t)$$

$$\vec{r}_{k_2} = \vec{r}_2(t) - \frac{d_2}{2}\vec{n}_2(t)$$

Where $d_1$ is the tube diameter of bundle 1 and $d_2$ is the tube diameter of bundle 2. The unit normal vector $$\vec{n}(t) \text{ of } \vec{r}_{k_1}$$

is positive denoting the upper surface of the tube whereas $$\vec{r}_{k_2}$$

is negative denoting the lower surface of the tube.

The tubes would have a minimum bundle spacing and touch tangent where $$\vec{r}_{k_1}(t_1) = \vec{r}_{k_2}(t_2)$$

And $$\vec{r}'_{k_1}(t_1) = \vec{r}'_{k_2}(t_2)$$

If $y_2(t)$ is of the form $$y_2(t) = y(t) + S_{min}$$

Then this system of equations can be solved to find the minimum bundle spacing $S_{min}$.

Figure 10:
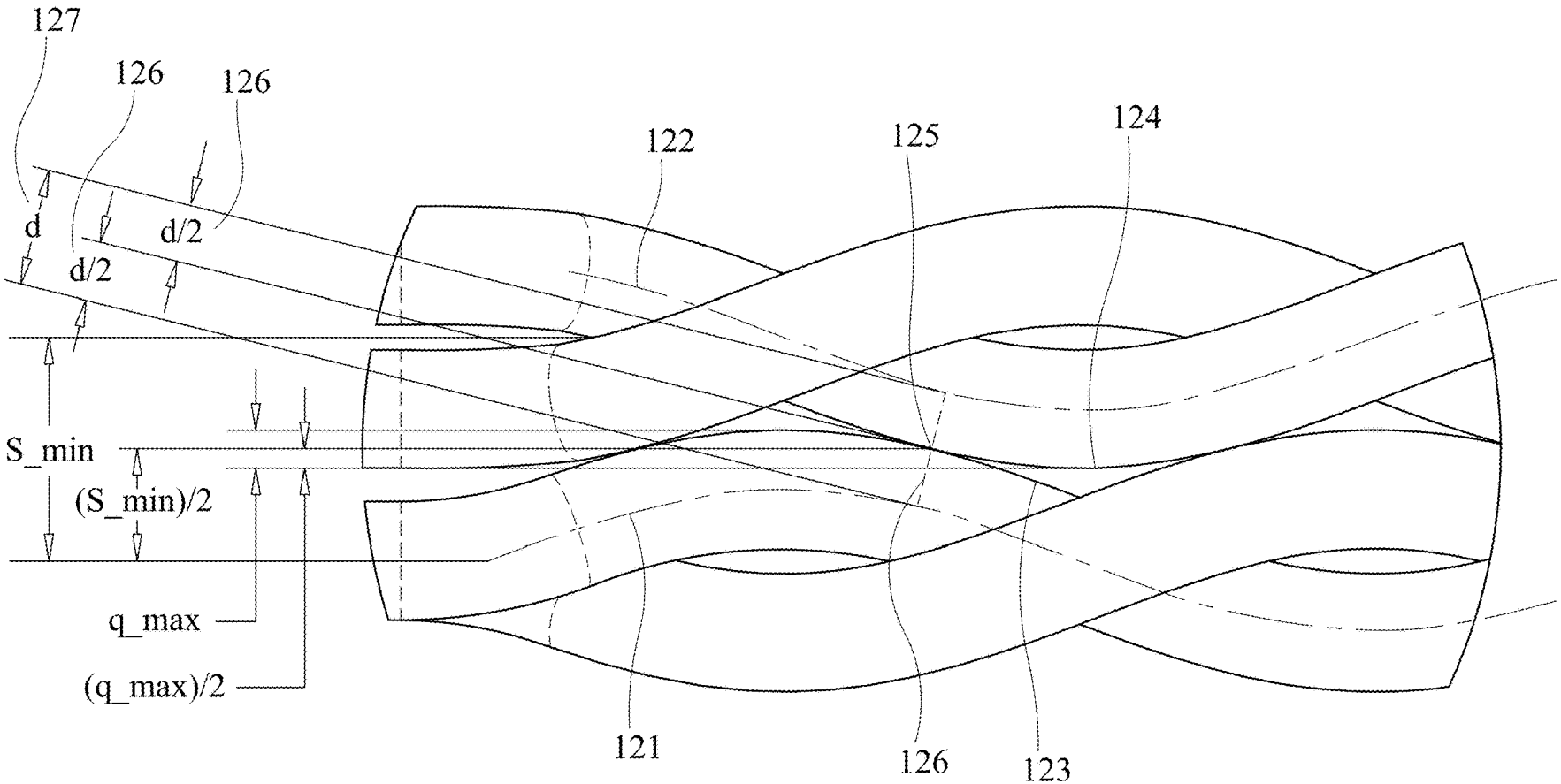
FIG. 10 shows the geometry of bundle overlap when tube bundles are positioned in phase according to the present invention.

A simplified example utilizing identical adjacent tube bundles, each tube having a constant helix diameter, pitch, and tube diameter, positioned perfectly in phase may be analyzed with reference in FIG. 10.

The centerline 121 of a tube of bundle 1 is $$y_1(\theta) = \frac{D}{2}\sin\theta$$

$$z(\theta) = -\frac{\theta \cdot P}{2\pi} = -\frac{\theta \cdot P}{360°}$$

The centerline 122 of a tube of bundle 2 which is perfectly phased with bundle 1 making its centerline $$y_2(\theta) = \frac{D}{2}\sin\left(\theta + 180° - \frac{\Phi}{2}\right) + S_{min} = S_{min} - \frac{D}{2}\sin\left(\theta - \frac{\Phi}{2}\right)$$

Where $$z_1(\theta) = z_2(\theta)$$

The tubes of the adjacent bundles have outside surfaces 123 and 124 offset by a tube radius 126. The two adjacent tube centerlines when are spaced at a normal distance of a tube diameter d 127 (2 tube radii). If the outside surface 123 of the tube, parameterized by t, is $$\vec{r}_k = (y_k(t), z_k(t))$$

Where $$k = \frac{d}{2},$$

then the point of contact 125 occurs at $$z_k(t) = z(\theta_{Tangency})$$

$$y_k(t) = \frac{S_{min}}{2}$$

Therefore, the minimum possible bundle spacing $S_{min}$ or maximum possible bundle overlap $q_{max}$ is dependent on the number of tubes per bundle N, the pitch P, the helix diameter D, and the tube diameter d.

The performance of a heat exchanger is directly related to the amount of surface area available to transfer heat. The amount of heat transfer capacity that can be fit into a given sized heat exchanger describes the volumetric efficiency of the heat exchanger. In the case of a tube and shell heat exchanger, more tubes inside of a given sized shell allows for more heat transferring surface area thus improving the volumetric efficiency. The packing efficiency of a tube and shell heat exchanger can be expressed as a fraction of the total volume that is occupied by tubes. Since each tube usually has one inlet, one outlet, and is of constant diameter along its length, this can be simplified from a volumetric efficiency to a two-dimensional area efficiency:

$$\text{Packing Efficiency} = \frac{\text{Total Tube Area}}{\text{Packing Area}}$$

To compare the packing efficiency of different helical tube bundle pattern units, the packing area can be defined as the area of the polygon having its corners at the helical axis of the bundles in the pattern unit. The tube area is the cross-sectional area of tubing within this polygon.

For comparison purposes, bundle overlap and packing efficiency were calculated in the context of tubing for an EGR cooler. In general, one of the design and manufacturing limitations of an EGR heat exchanger is the tube-to-tube spacing. The tubes may require sufficient flow and surface area available for heat exchange to avoid certain adverse effects such as localized boiling. Production of the end bulkhead or tube sheet may require a minimum web distance between holes. Reducing the spacing between tubes would increase the packing efficiency. So, for comparison purposes, it is advantageous to hold the tube-to-tube spacing "t" constant across all bundle configurations. This spacing applies not only to the spacing between tubes of the same bundle, but to the spacing between tubes of adjacent bundles as well.

Figure 11:
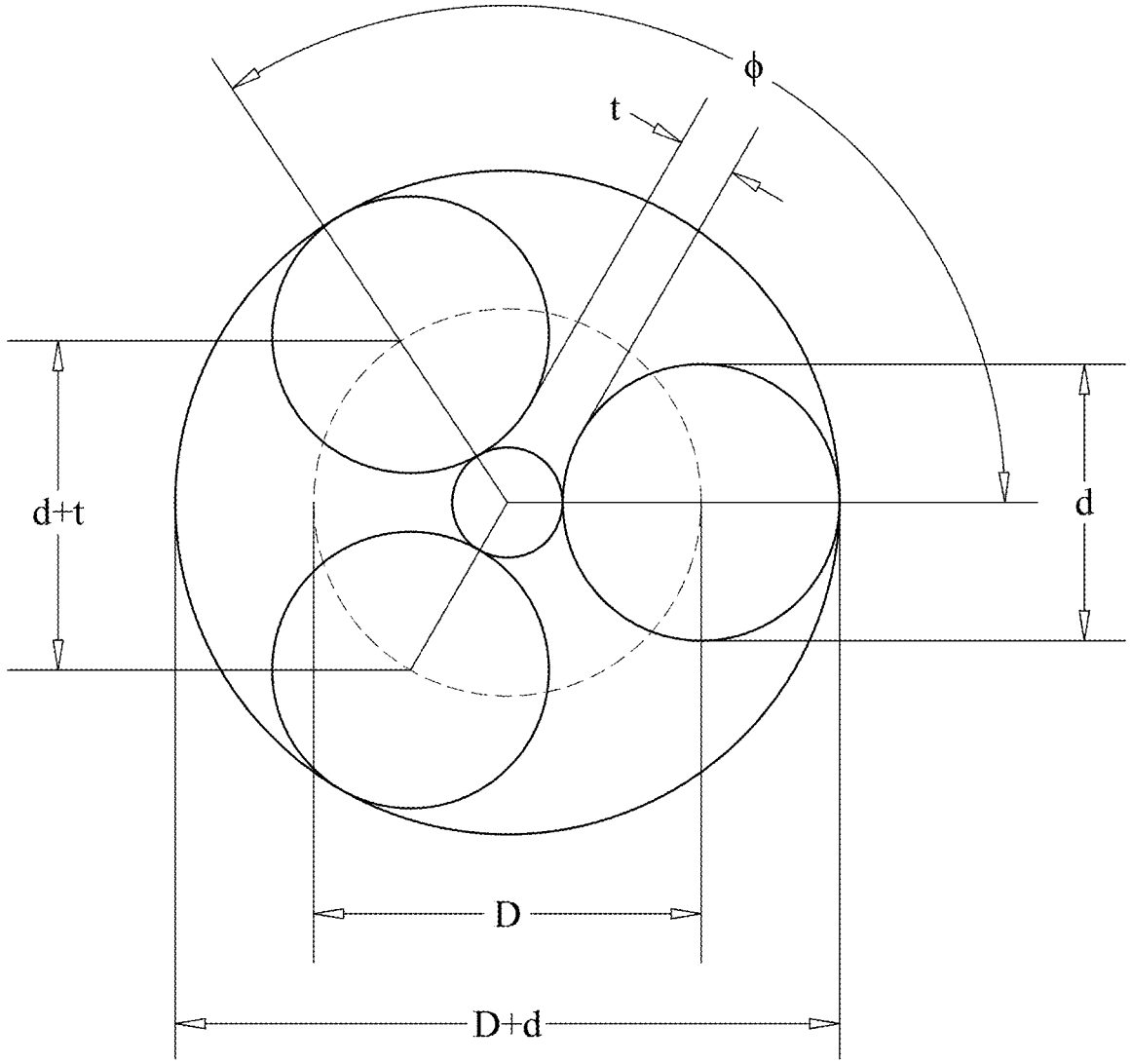
FIG. 11 depicts the end-on dimensions of a typical tube bundle.

With reference to FIG. 11, for a constant tube diameter d and tube spacing t, $$D = \frac{d+t}{\sin\left(\frac{\Phi}{2}\right)} = \frac{d+t}{\sin\left(\frac{\pi}{N}\right)}$$

Using this model, one can calculate bundle overlap, bundle spacing and packing efficiency. In an EGR cooler manufactured for use as disclosed in U.S. Pat. No. 9,605,912, the preferred standard helical tube dimensions are d=.250", t=.0531" (due to manufacturing tooling) and p=2.500". The results are shown in Table 1.

TABLE 1

| Pattern | N Tubes per Bundle | B Bundles per Pattern | Helical Direction | q Bundle | q' Overlap | S Bundle | S' Spacing | Packing Efficiency |
|---|---|---|---|---|---|---|---|---|
| Square | 3 | 4 | Counter | .0556 | | .5444 | | 49.69% |
| Rectangular | 3 | 4 | Counter | .0750 | .0494 | .5250 | .5506 | 50.94% |
| Square | 2 | 4 | Counter | .1391 | | .4141 | | 57.26% |
| Square | 3 | 4 | Same | .0144 | | .5856 | | 42.95% |
| Square | 2 | 4 | Same | .0806 | | .4726 | | 43.96% |
| Equilateral Triangle | 3 | 3 | Same | .0416 | | .5584 | | 54.52% |

It is also possible to achieve bundle to bundle spacing less than the outside diameter (D+d) by positioning in phase certain dissimilar adjacent bundles. Table 2 shows bundle overlap, bundle spacing and packing efficiency for square patterns of 4 bundles per pattern where adjacent bundles with standard dimension t=.0531" have dissimilar pitch P, number of tubes N, and/or tube diameter d.

TABLE 2

| | | | | | q Bundle Overlap | S Bundle Spacing | Packing Efficiency |
|---|---|---|---|---|---|---|---|
| d = .250 | N = 2 | $P_1 = 2.5$ | $P_2 = 7.5$ | | .0198 | .5333 | 34.52% |
| d = .250 | $N_1 = 2$ | $N_2 = 4$ | $P_1 = 2.5$ | $P_2 = 5$ | .0480 | .5679 | 45.66% |
| $d_1 = .250$ | $d_2 = .375$ | N = 2 | P = 2.5 | | .0901 | .5880 | 46.14% |

EXAMPLE EMBODIMENT

Figure 12:
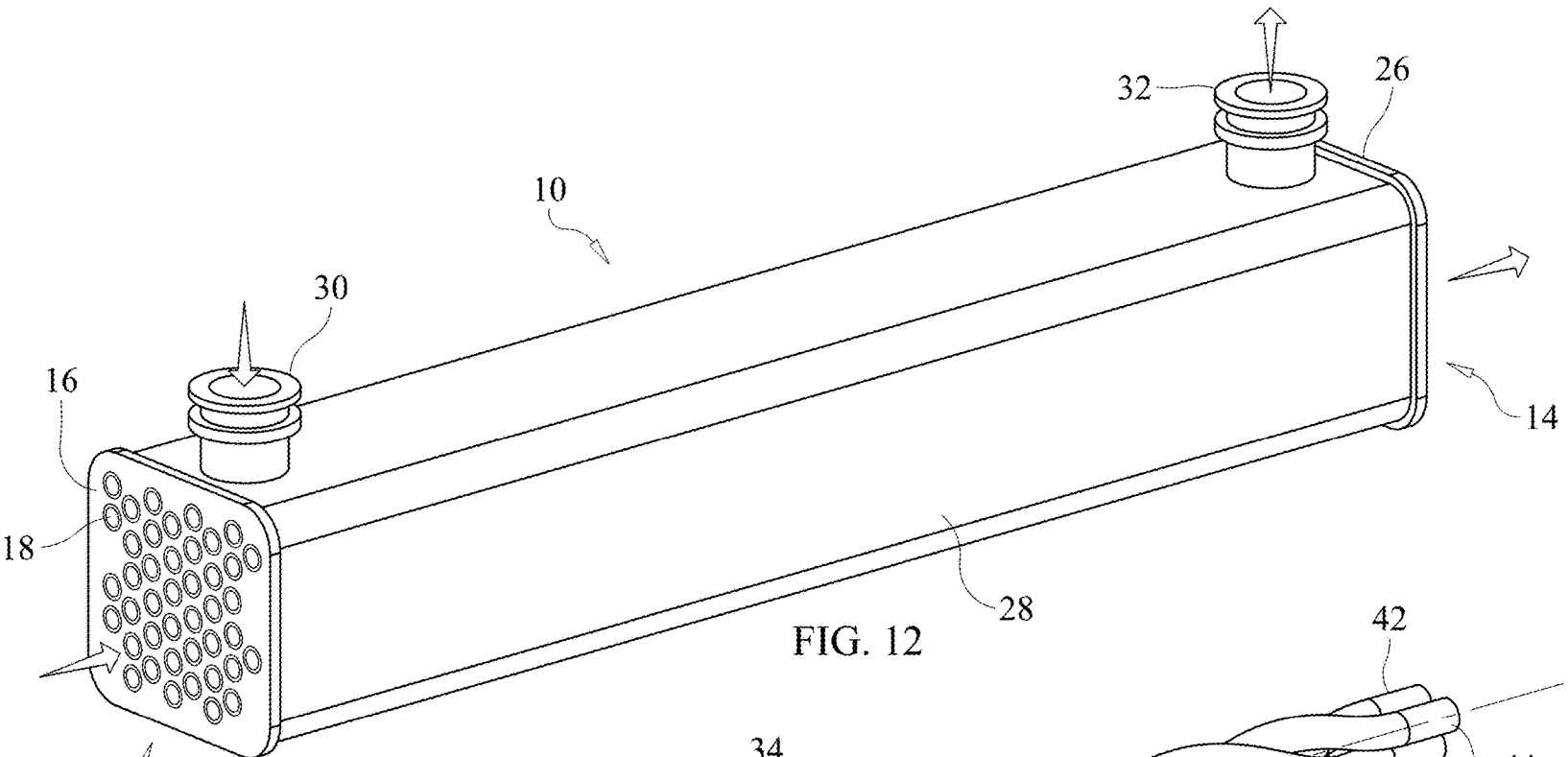
FIG. 12 shows an encasement of an EGR cooler embodiment of the present invention.

A preferred embodiment of the invention is an EGR cooler implementing a 3×3 pattern unit (3 bundle patterns of 3-tube bundles). See FIGS. 14 & 15. In the illustrative embodiment of FIG. 12, heat exchanger 10 comprises an EGR cooler having gas inlet end 12 and a gas outlet end 14 adapted to receive a flow of exhaust gas from a diesel engine. Gas inlet end 12 comprises a tube header consisting of a bulkhead 16 having a plurality of perforations 18. A plurality of hollow passageways such as tubes 20, 22 and 24 (FIG. 15) are mechanically coupled to bulkhead 16 in registry with perforations 18 (e.g., by welding, brazing or similar rigid attachment) to form a fluid-tight seal between the tubes and the bulkhead. Bulkhead 26 located at gas outlet end 14 is of identical construction and therefore will not be discussed in detail herein. Bulkhead 16 and bulkhead 26 are fluidically connected (e.g., by appropriate flanged connections and exhaust system pipes, not shown) to the diesel engine exhaust system.

A shell 28 extends between bulkhead 16 and bulkhead 26 and is mechanically coupled to bulkhead 16 and to bulkhead 26 (e.g., by welding, brazing, or similar rigid attachment) to form a fluid-tight seal between the bulkheads and the shell. Shell 28 is provided with a coolant inlet passage 30 and a coolant outlet passage 32 to enable a flow of coolant to flow into shell 28 past the tubes contained within shell 28 and then out of shell 28 to an external radiator or other means of discharging the heat rejected from tubes 20-24. Although in the illustrative embodiment of FIG. 12 heat exchanger 10 comprises a parallel flow heat exchanger with coolant inlet passage 30 adjacent gas inlet end 12, the invention should not be considered as limited to the parallel flow heat exchanger embodiment. For example, a counter flow heat exchanger in which coolant inlet passage 30 is adjacent gas outlet end 14 is considered within the scope of the invention.

Figure 13:
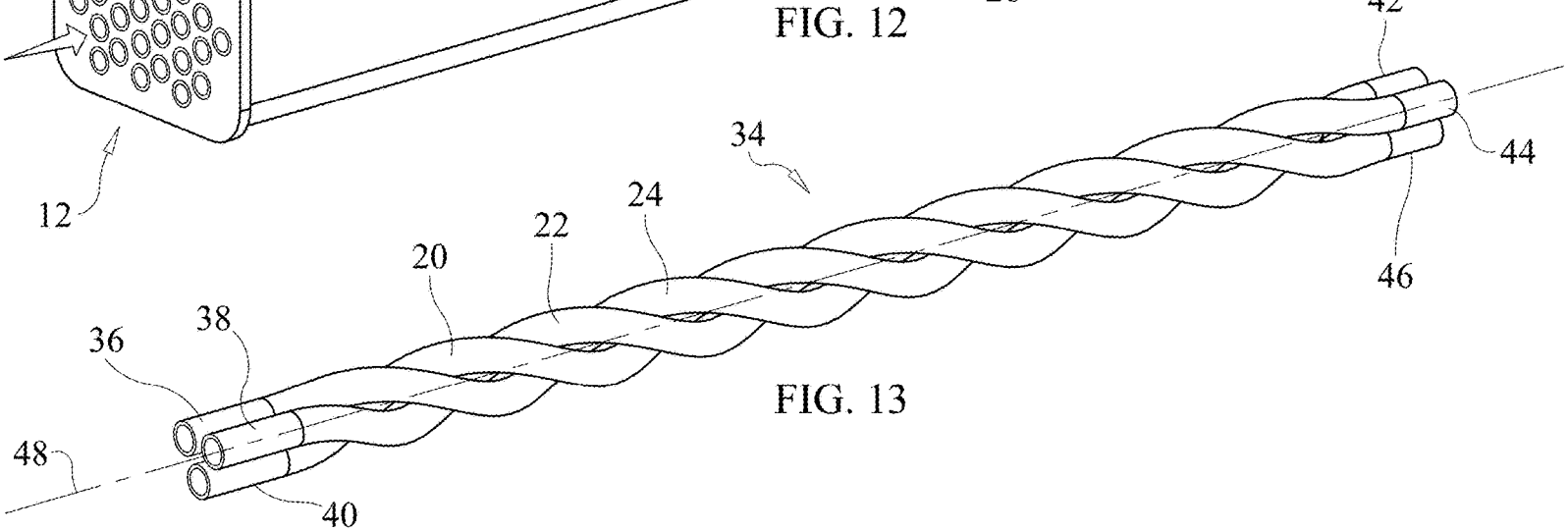
FIG. 13 shows a preferred tube bundle for implementation of the embodiment of FIG. 12.

With additional reference to FIG. 13, in the illustrative embodiment the tubes running between bulkhead 16 and bulkhead 26 are arranged into a plurality of tube bundles such as tube bundle 34. Each tube bundle 34 is composed of a plurality of individual tubes, e.g., three individual tubes 20, 22, 24. Each of the individual tubes has a relatively short straight section 36, 38, 40 at the gas inlet end 12 and a relatively short straight section 42, 44, 46 at gas outlet end 14. In between the relatively short straight sections, each of the three individual tubes 20, 22, 24 is wound into a helix, each of which has the same helical pitch, helical radius, and helical twist direction (e.g., right-hand or left-hand). All of the individual tubes 20, 22, 24 of tube bundle 34 share a common helical axis 48.

Figure 14:
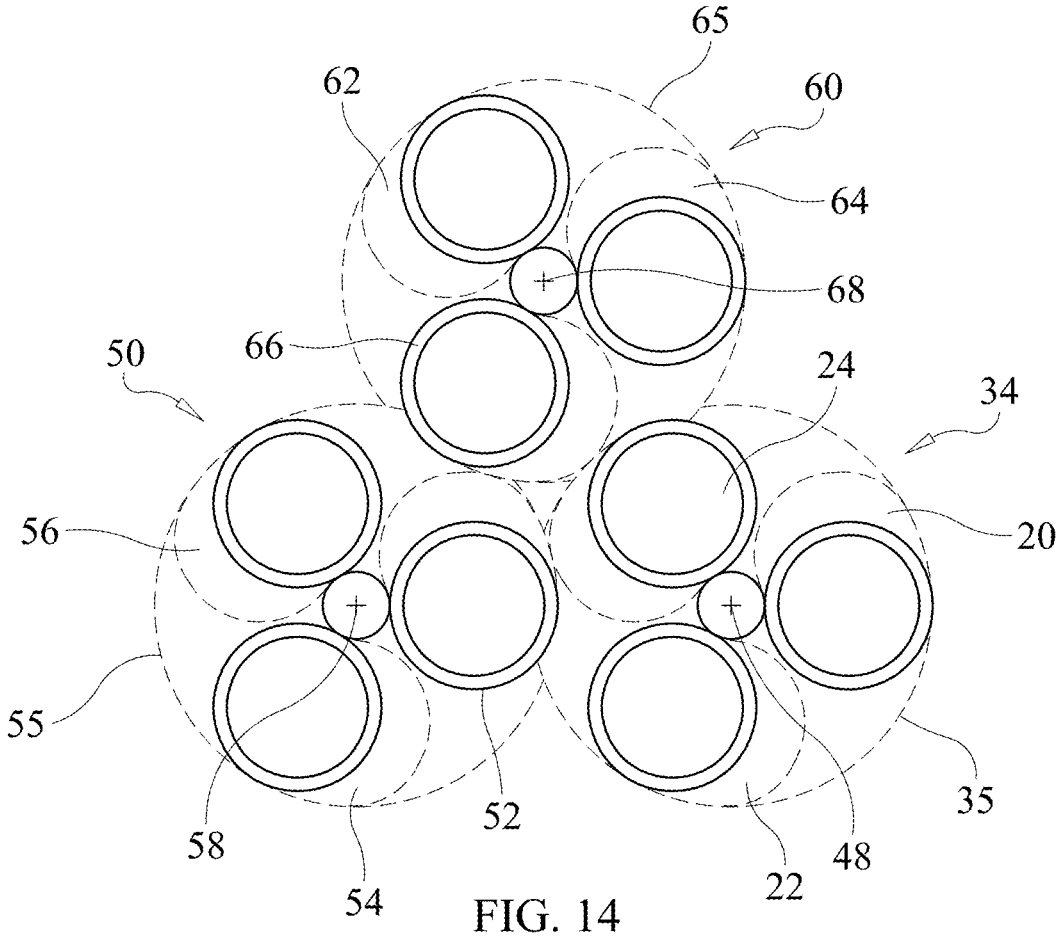
FIG. 14 is an end view of a bundle configuration for implementation of the embodiment of FIG. 13.

With additional reference to FIG. 14, tube bundle 34 is shown adjacent to a second tube bundle 50 and a third tube bundle 60. Tube bundle 50 is composed of a plurality of individual tubes, e.g., three individual tubes 52, 54 and 56. Each of the individual tubes has a relatively short straight section (not shown) at the gas inlet end 12 and a relatively short straight section (not shown) at gas outlet end 14. In between the relatively short straight sections, each of the three individual tubes 52, 54 and 56 is wound into a helix, each of which has the same helical pitch, helical diameter, and helical twist direction. All of the individual tubes 52, 54 and 56 of tube bundle 50 share a common helical axis 58. Helical axis 58 is parallel to helical axis 48. Tube bundle 60 is composed of a plurality of individual tubes, e.g., three individual tubes 62, 64 and 66. Each of the individual tubes has a relatively short straight section (not shown) at the gas inlet end 12 and a relatively short straight section (not shown) at gas outlet end 14. In between the relatively short straight sections, each of the three individual tubes 62, 64 and 66 is wound into a helix, each of which has the same helical pitch, helical diameter, and helical twist direction. All of the individual tubes 62, 64 and 66 of tube bundle 60 share a common helical axis 68. Helical axis 68 is parallel to helical axis 48 and parallel to helical axis 58.

Tube bundles 34, 50 and 60 are positioned in phase with one another. The outer surface of tube 24, constituting the peak of tube bundle 34, is aligned with the valley between tubes 64 and 66 (of tube bundle 60). The outer surface of tube 66 is aligned with the valley formed by tubes 52 and 56 (of tube bundle 50). The outer surface of tube 52 is aligned with the valley formed by tubes 22 and 24 (of tube bundle 34). As discussed in connection with FIGS. 7 and 8, adjacent tube bundles are positioned so that the bundle spacing is less than the sum of the helical (coil) diameter of a bundle (D) plus the diameter of a tube (d), a distance shown as 35, 55 and 65 in the respective bundles. In some embodiments adjacent tube bundles actually touch tangent to each other.

Figure 15:
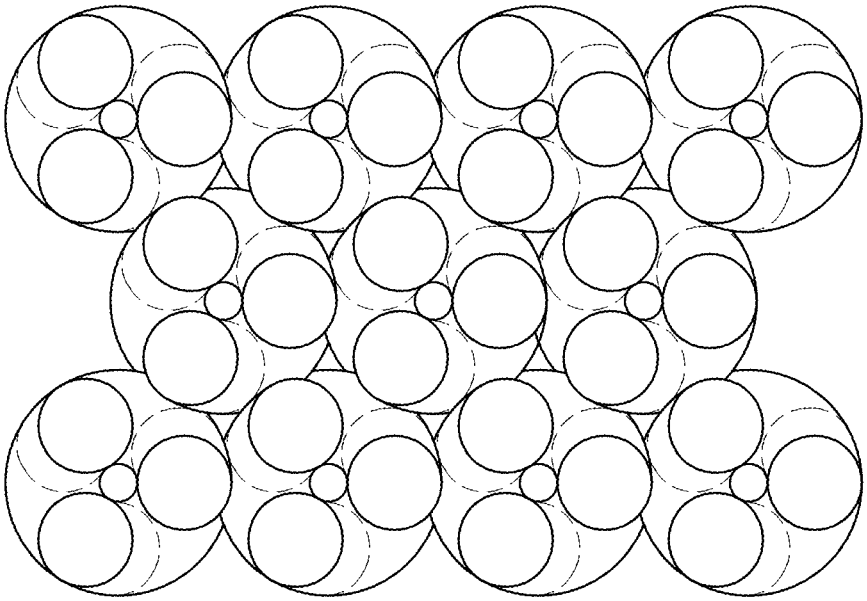
FIG. 15 is a cross section view of multiple bundles in the embodiment of FIG. 13.

The 3×3 pattern unit, comprising three adjacent 3-tube bundles, can be repeated to form a matrix of tube bundles, as seen in FIG. 15.

Figure 16:
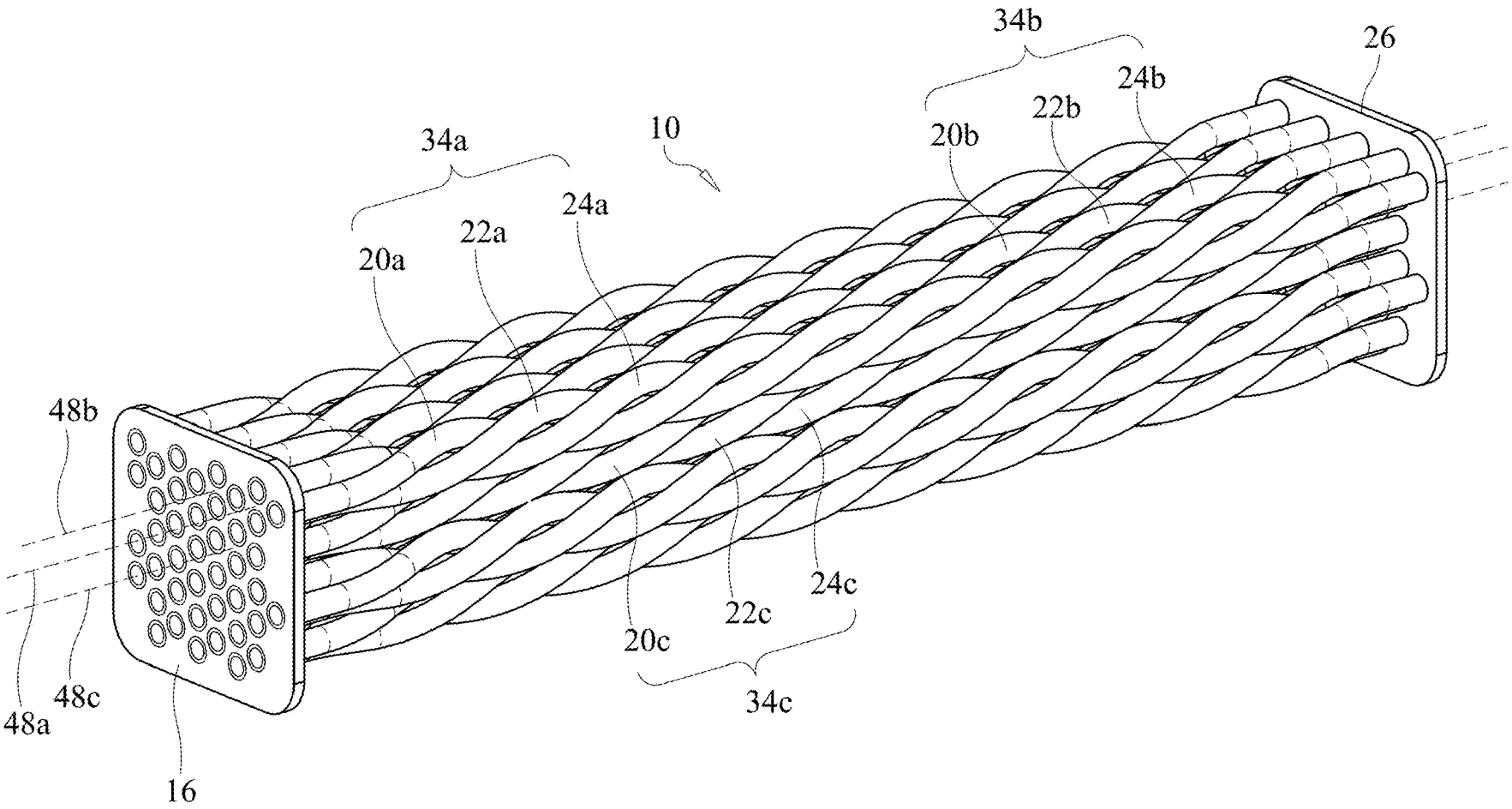
FIG. 16 is a side view of the tube components of the embodiment of FIG. 13.

With additional reference to FIG. 16, in the illustrative embodiment, heat exchanger 10 comprises fourteen tube bundles attached between bulkhead 16 and bulkhead 26. The upper horizontal row of tube bundles consists of a tube bundle 34 a consisting of tubes 20*a*, 22*a* and 24*a* all of which have a left-hand helical twist. Immediately adjacent to tube bundle 34*a* is an identical tube bundle 34*b* consisting of tubes 20*b*, 22*b* and 24*b* all of which also have a left-hand helical twist. Immediately below and adjacent to both tube bundle 34*a* and 34*b* is an identical tube bundle 34*c* consisting of tubes 20*c*, 22*c* and 24*c* all of which have a left-hand helical twist. The three tube bundles are arranged in a triangular array in which the helical axes 48*a*, 48*b*, and 48*c* are parallel. As can be seen from FIG. 16, the remainder of the tube bundles are arranged with the helical axes laid out in a series of triangular arrays forming a triangular matrix such that the helical axes of each tube bundle are equidistance from all adjacent tube bundle helical axes. In the matrix, each tube bundle is adjacent on all sides to tube bundles having the same helical twist.

With reference to the figures and in particular the example embodiment, incorporating features of the present invention may be used as a heat exchanger for a variety of purposes in which it is desired to transfer heat from one fluid medium to another fluid. In one example, the heat exchanger may be used as an exhaust gas recirculation (EGR) cooler. A heat exchanger incorporating features of the present invention may, however, used in connection with any appropriate application to transfer heat from a fluid on one side of a barrier to a fluid on the other side of the barrier without bringing the fluids into contact. A heat exchanger incorporating the teachings of the present invention may be used with all types of fluids, for example air-to-air, air-to-liquid, liquid-to-liquid as appropriate to meet the particular needs of the application.

Although certain illustrative embodiments and methods have been disclosed herein, it will be apparent from the foregoing disclosure to those skilled in the art that variations and modifications of such embodiments and methods may be made without departing from the invention. Additionally, although the tubes forming the tube bundles in the illustrative embodiment are circular in cross section, tubes having non-circular cross sections may be advantageously used in a heat exchanger incorporating features of the present invention and therefore are considered within the scope of the invention. Also, it should be observed that although the helical axis of the tube bundles extends from bulkhead-to-bulkhead, it is not necessary that the tube bundles be continuously helical from bulkhead-to-bulkhead as long as they are helical about a common helical axis over some portion of their length. Accordingly, it is intended that the invention should be limited only to the extent required by the appended claims and the rules and principles of applicable law. Additionally, as used herein, references to direction such as "up" or "down" are intended to be exemplary and are not considered as limiting the invention and, unless otherwise specifically defined, the terms "generally" "substantially," or "approximately" when used with mathematical concepts or measurements mean within ±10 degrees of angle or within 10 percent of the measurement, whichever is greater.

We claim:

1. A helical coil heat exchanger comprising at least three bundles of helical tubes, each bundle comprising a plurality of helical tubes of the same hand twist as each of the other bundles, and each bundle having a common helical axis and an outside surface with peaks and valleys, wherein the helical axis of each bundle is parallel to and in a location radially offset from and equidistant from the helical axes of the other bundles and the bundles are positioned for bundle overlap so a plurality of peaks of one bundle are in the valleys between the peaks of bundles adjacent to it.

2. The heat exchanger of claim 1, wherein each bundle comprises a plurality of helical tubes with the same coil diameter, tube diameter and pitch.

3. The heat exchanger of claim 2, wherein all the tube bundles have the same coil diameter, tube diameter and pitch.

4. The heat exchanger of claim 3, comprising bundles of three tubes positioned as groups of three adjacent bundles.

5. The heat exchanger of claim 3, wherein each bundle has a coil diameter D, a tube diameter d and a bundle center located at the bundle axis and the distance between the centers of adjacent bundles is less than the sum of the coil diameter length and the tube diameter length.

6. The heat exchanger of claim 5, wherein the tubes of the adjacent bundles touch tangent at points between the bundle peaks and valleys.

7. A heat exchanger for transferring heat between a first fluid and a second fluid comprising:

a first tube bundle comprising a first set of three tubes adapted to allow the first fluid to flow therethrough, the tubes each having an inlet forming a first set of inlets, the tubes each having an outlet forming a first set of outlets, the first set of inlets being attached to an inlet support at an inlet end, the first set of outlets being attached to an outlet support at an outlet end, each of the first set of tubes following a helical path along a first common helical axis, the helical path of each of the first plurality of tubes having the same twist direction, substantially the same helical pitch and helical radius and symmetric peaks and valleys along the bundle length;

a second tube bundle comprising a second set of three tubes adapted to allow the first fluid to flow therethrough, the second set of tubes each having an inlet forming a second set of inlets, the second set of tubes each having an outlet forming a second set of outlets, the second set of inlets being attached to the inlet support at the inlet end, the second set of outlets being attached to the outlet support at the outlet end, each of the second set of tubes following a helical path along a second common helical axis in the same twist direction as that of the first tube bundle, the helical path of each of the second set of tubes having substantially the same helical pitch and helical radius and symmetric peaks and valleys along the bundle length as the first set of tubes;

a third tube bundle comprising a third set of three tubes adapted to allow the first fluid to flow therethrough, the third set of tubes each having an inlet forming a third set of inlets, the third set of tubes each having an outlet forming a third set of outlets, the third set of inlets being attached to the inlet support at the inlet end, the third set of outlets being attached to the outlet support at the outlet end, each of the third set of tubes following a helical path along a third common helical axis in the same twist direction as that of the first and second tube bundles, the helical path of each of the third set of tubes having substantially the same helical pitch and helical radius and symmetric peaks and valleys along the bundle length as the first set of tubes; and a shell surrounding the first, second and third tube bundles, the shell having an inlet port and an outlet port for flowing the second fluid through the shell past the first, second and third tube bundles and symmetric peaks and valleys along the bundle length; wherein the helical axes of the first, second and third bundles are parallel to, radially offset from, and equidistant from each other, forming the corners of an equilateral triangle, and the bundles are positioned for bundle overlap so that peaks of each bundle are in the valleys between the peaks of each adjacent bundle.

8. The heat exchanger of claim 7, wherein each bundle has a coil diameter D, a tube diameter d and a bundle center located at the bundle axis and the distance between the centers of adjacent bundles is less than the sum of the diameter length and the tube diameter length.

9. The heat exchanger of claim 7, further including a plurality of additional adjacent tube bundles, each comprising a set of three tubes, each bundle adapted to allow the first fluid to flow therethrough, the set of tubes each having an inlet forming a set of inlets, the set of tubes each having an outlet forming a set of outlets, the set of inlets being attached to the inlet support at the inlet end, the set of outlets being attached to the outlet support at the outlet end, each of the plurality of tubes following a helical path along a common helical axis in the same twist direction as that of the first tube bundle, the helical path of each additional set of tubes having substantially the same helical pitch and helical radius and symmetric peaks and valleys along the bundle length as the first set of tubes; wherein the helical axis of each additional tube bundle is parallel to the helical axes of the other tube bundles, and the additional tube bundles are positioned for bundle overlap so that peaks of each bundle are in the valleys between the peaks of adjacent tube bundles.

10. A helical coil heat exchanger comprising at least three bundles of helical tubes, each bundle comprising the same number of helical tubes of the same hand twist as each of the other bundles, and each bundle having a common helical axis and an outside surface with peaks and valleys, wherein the helical axis of each bundle is parallel to and in a location radially offset from the helical axes of the other bundles; and wherein the bundles are arranged in a closed pattern such that the number of bundles is an integer times the number of tubes in each bundle and the bundles are positioned for bundle overlap so a plurality of peaks of one bundle are in the valleys between the peaks of bundles adjacent to it.

11. The heat exchanger of claim 10, wherein each bundle comprises a plurality of helical tubes with the same coil diameter, tube diameter and pitch.

12. The heat exchanger of claim 11, wherein all the tube bundles have the same coil diameter, tube diameter and pitch.

13. The heat exchanger of claim 10, comprising bundles of three tubes positioned as groups of three adjacent bundles.

14. The heat exchanger of claim 10, comprising bundles of four tubes positioned as closed groups of four adjacent bundles.

15. The heat exchanger of claim 10, comprising bundles of five tubes positioned as closed groups of five adjacent bundles.

16. The heat exchanger of claim 12, wherein each bundle has a coil diameter D, a tube diameter d and a bundle center located at the bundle axis and the distance between the centers of adjacent bundles is less than the sum of the coil diameter length and the tube diameter length.

* * * * *